US007465255B2

(12) United States Patent
Chen

(10) Patent No.: US 7,465,255 B2
(45) Date of Patent: Dec. 16, 2008

(54) TREADMILL FOR ENABLING A USER TO TREAD AND TWIST

(76) Inventor: Tsung-Yu Chen, 235 Chung-Ho Box 8-24, Taipei (TW)

( * ) Notice: Subject to any disclaimer, the term of this patent is extended or adjusted under 35 U.S.C. 154(b) by 684 days.

(21) Appl. No.: 10/967,786

(22) Filed: Oct. 19, 2004

(65) Prior Publication Data

US 2006/0084553 A1 Apr. 20, 2006

(51) Int. Cl.
*A63B 22/04* (2006.01)

(52) U.S. Cl. ..... 482/53

(58) Field of Classification Search ..... 482/51–53, 482/57

See application file for complete search history.

(56) References Cited

U.S. PATENT DOCUMENTS 5,453,065 A * 9/1995 Lien et al. ..... 482/52
5,545,111 A * 8/1996 Wang et al. ..... 482/53
6,224,515 B1 * 5/2001 Chen ..... 482/53
6,315,697 B1 * 11/2001 Chen ..... 482/53
2002/0155926 A1 * 10/2002 Lat ..... 482/52

* cited by examiner

*Primary Examiner*—Steve R Crow
(74) *Attorney, Agent, or Firm*—Banger Shia

(57) ABSTRACT

Disclosed is a treadmill for enabling a user to tread and twist. The treadmill includes a base, a post extended from the base, a pivotal unit including two inclined axles extended from the post, two treadles each connected to a related one of the inclined axles, two hydraulic cylinders each comprising an end connected to a related one of the treadles and another end connected to the base and a linking unit. The linking unit includes two cranks each connected to a related one of the inclined axles, a U-shaped element connected to the post, a pulley supported on the U-shaped element and a rope wound around the pulley and formed with two end each connected to a related one of the cranks.

4 Claims, 4 Drawing Sheets

TREADMILL FOR ENABLING A USER TO TREAD AND TWIST

FIELD OF THE INVENTION

The present invention relates to a treadmill and, more particularly, to a treadmill for enabling a user to tread and twist.

BACKGROUND OF THE INVENTION

Treadmills are widely used because they are compact and enable users to exercise efficiently.

Conventional treadmills only allow users to move their legs up and down so that the users use mainly the muscles in their thighs, without using the muscles in their waists and hips. Therefore, the users cannot reduce their waistlines and make their hips tight.

A conventional treadmill includes a rectangular frame. A handle is provided at a front end of the rectangular frame, and a Y-shaped element is provided at a rear end of the rectangular frame. Two sleeves are provided on two branches of the Y-shaped element. A treadle is extended from each sleeve. The free end of each branch is provided with a V-shaped element for increasing the treading force on a related treadle. A hydraulic cylinder is provided between a front end of each treadle and a related V-shaped element. A hydraulic cylinder is provided between a rear end of each treadle and the rectangular frame. Thus, the treadles can be moved up and down. There are however problems with this conventional treadmill. At first, the structure is complicated so that the size is big. Hence, the cost is high and the transportation is difficult. Furthermore, it only allows a user to move his or her legs up and down, not allowing the user to use the muscles in the waist and hips.

SUMMARY OF THE INVENTION

Therefore, the primary objective of the present invention is to provide a treadmill for enabling a user to tread and twist, thus moving the muscles in the thighs, waist and hips.

To fulfill the primary objective of the present invention, the treadmill includes a base, a post extended from the base, a pivotal unit including two inclined axles extended from the post, two treadles each connected to a related one of the inclined axles, two hydraulic cylinders each comprising an end connected to a related one of the treadles and another end connected to the base and a linking unit. The linking unit includes two cranks each connected to a related one of the inclined axles, a U-shaped element connected to the post, a pulley supported on the U-shaped element and a rope wound around the pulley and formed with two end each connected to a related one of the cranks.

The various objects and advantages of the present invention will be more readily understood from the following detailed description when read in conjunction with the appended drawing.

DETAILED DESCRIPTION OF THE INVENTION

Figure 1:
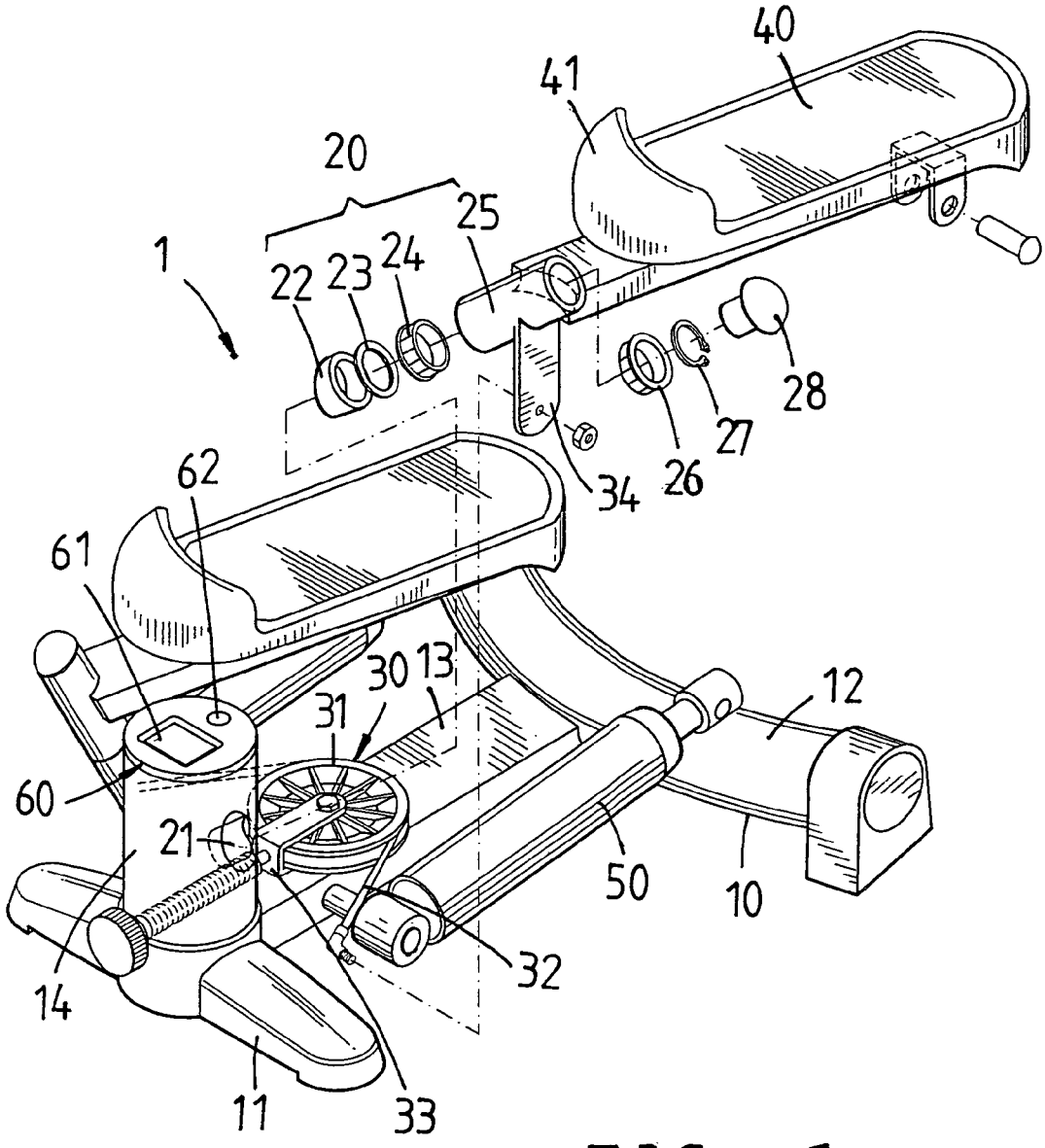
FIG. 1 is an exploded view of a treadmill according to the preferred embodiment of the present invention.
Figure 2:
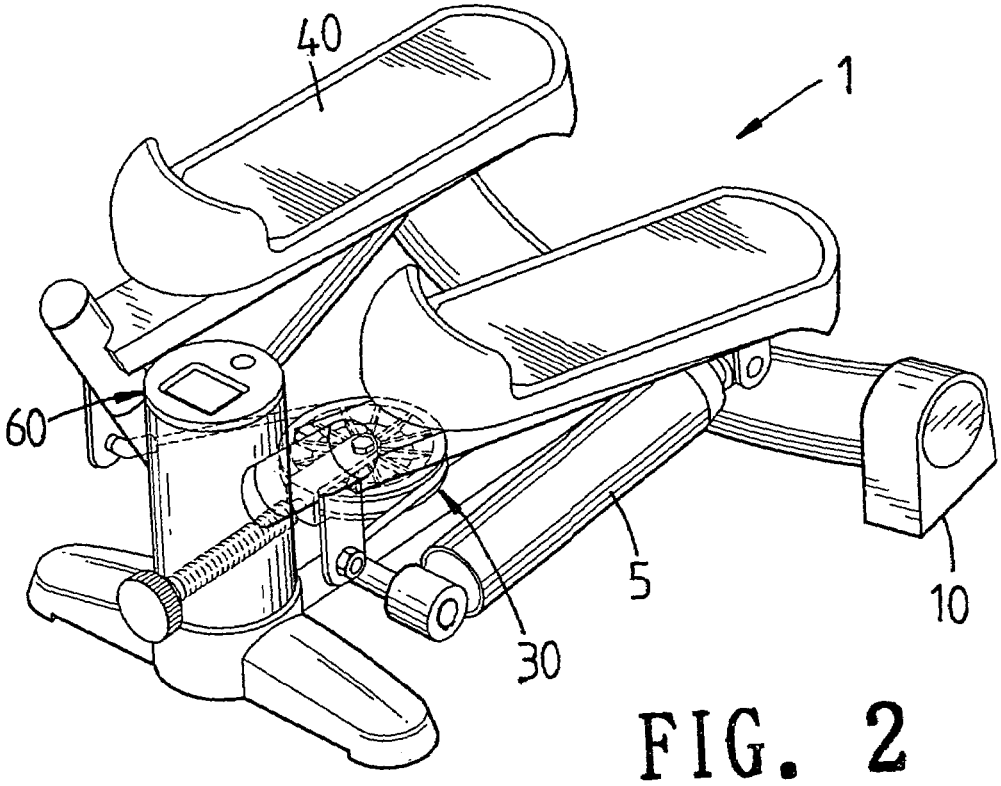
FIG. 2 is a perspective view of the treadmill shown in FIG. 1.

With reference to FIGS. 1 and 2, there is shown a treadmill 1 for enabling a user to tread and twist according to the preferred embodiment of the present invention. The treadmill 1 includes a base 10, a pivotal unit 20, a linking unit 30, two treadles 40, two hydraulic cylinders 50 and a counter 60.

The base 10 includes a front crossbar 11, a rear crossbar 12, a keel 13 formed between the front crossbar 11 and the rear crossbar 12 and a post 14 formed on the front crossbar 11. The rear crossbar 12 is curved.

The pivotal unit 20 includes two inclined axles 21 each extending upwards obliquely from a side of the post 14 so that the inclined axles 21 together form a V-shaped structure. A collar 22, a washer 23, a lower ring 24, a sleeve 25, an upper ring 26, a C-clip 27 and a cap 28 are sequentially provided on each inclined axle 21.

The linking unit 30 includes a pulley 31, a rope 32, a U-shaped element 33 and two cranks 34. The U-shaped element 33 is secured to the post 14 by an adjusting screw driven through the post 14. The pulley 31 is supported on the U-shaped element 33. The rope 32 is wound around the pulley 31. Each crank 34 is connected to an end of the rope 32. On the other hand, each connecting rod 34 is secured to a related sleeve 25. Thus, the sleeves 25 are connected to each other by the linking unit 30.

Each treadle 40 is secured to a related sleeve 25. The treadles 40 can support a user's feet. A front end of each treadle 40 is formed with a stopper 41 to prevent the user s foot from slipping.

The hydraulic cylinders 50 are located on two sides of the keel 13. Each hydraulic cylinder 50 includes an end connected to the keel 13 by a universal joint and another end connected to a related treadle 40 for providing resistance to the user while treading.

The counter 60 is attached to an upper end of the post 14 to provide information about how much the user exercises with the treadmill 1. The counter 60 includes a display 61 provided thereon for displaying the information and a control portion 62 operable for controlling the counter 60. For example, the control portion 62 is operable to reset the counter 60.

Figure 3:
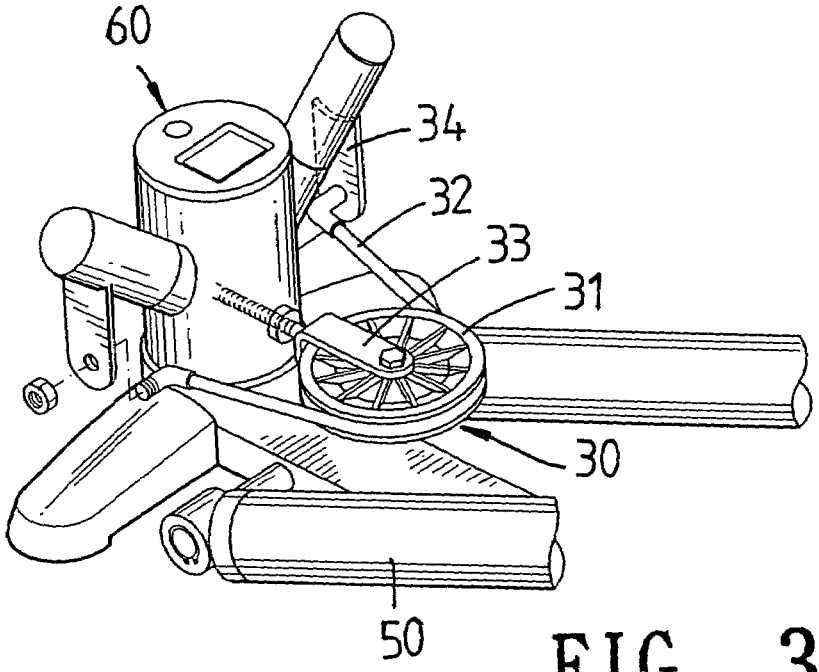
FIG. 3 is a partial view of the treadmill shown in FIG. 2.
Figure 4:
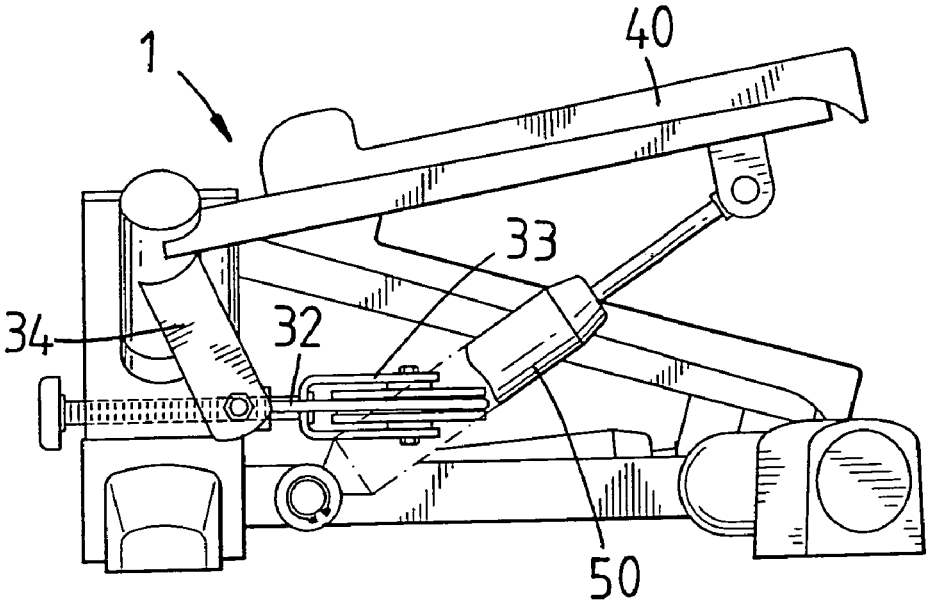
FIGS. 4 and 5 are two side views of the treadmill shown in FIG. 2.
Figure 5:
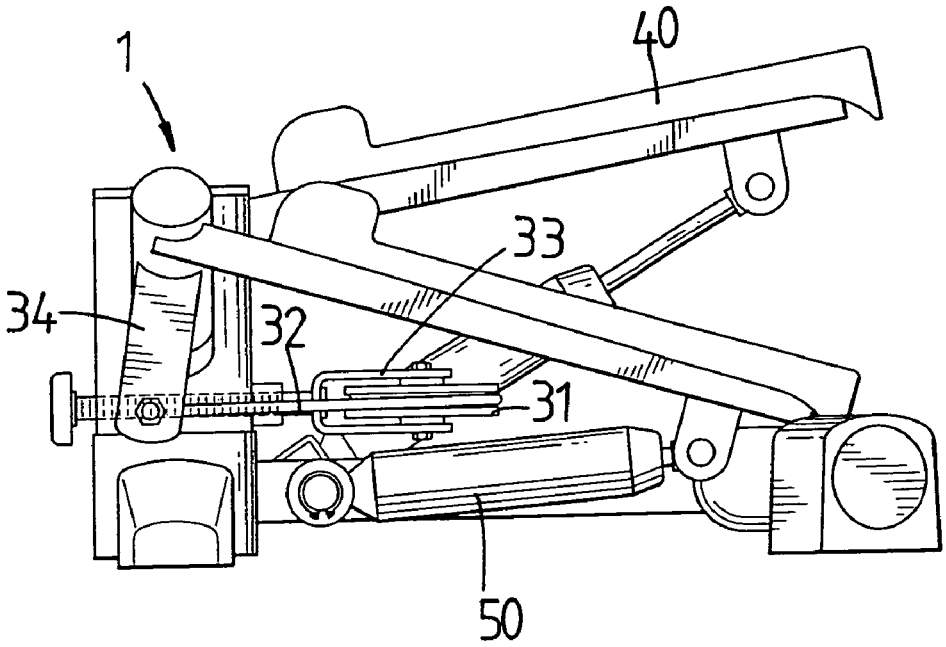

With reference to FIG. 3, the linking unit 30 is attached to a rear side of the post 14. By the pulley 31 and the rope 32, a treadle 40 is trodden down while the other treadle 40 is lifted as shown in FIGS. 4 and 5.

Figure 6:
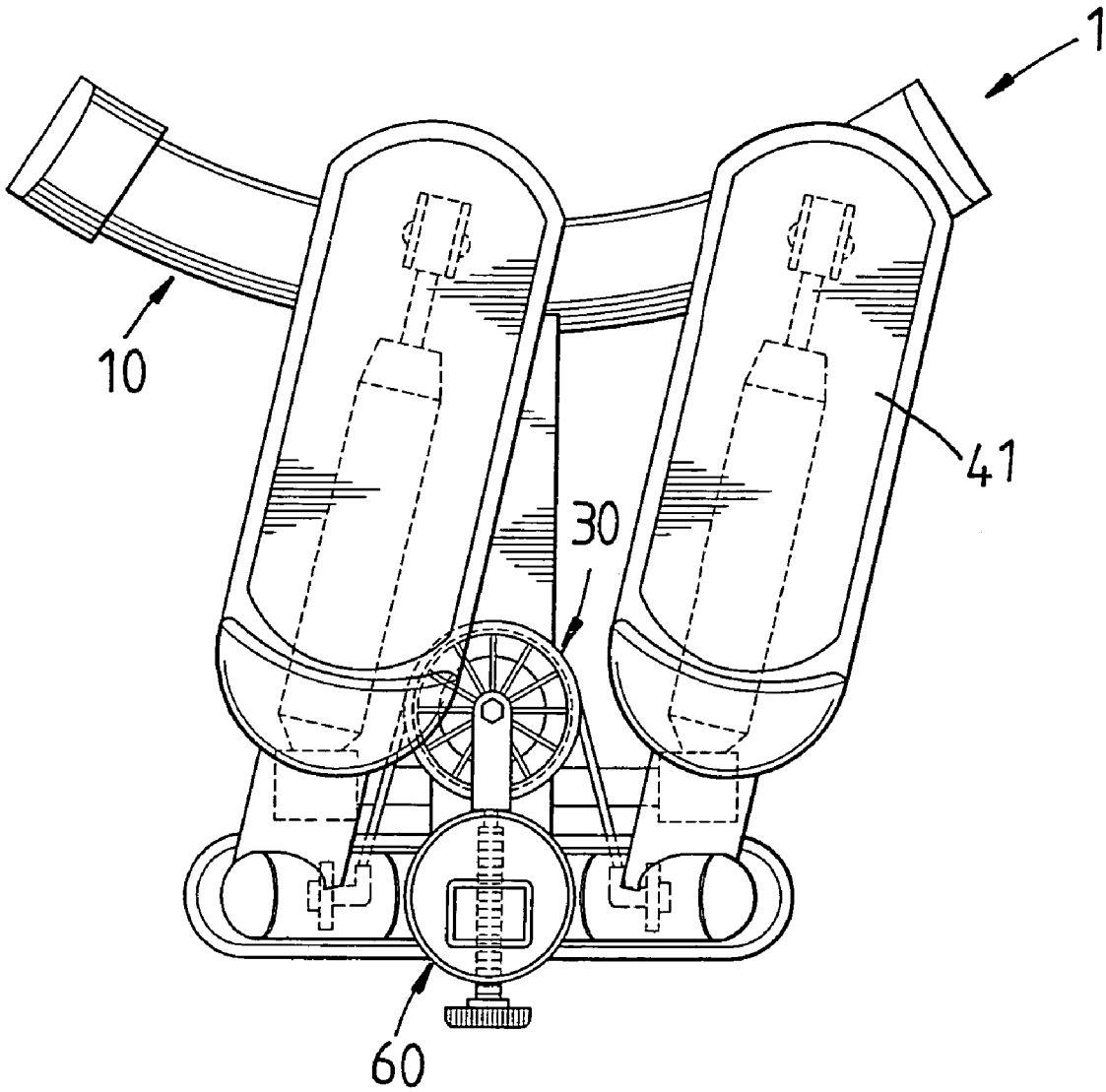
FIG. 6 is a top view of the treadmill shown in FIG. 2.

The pivotal unit 20 on the post 14 renders the movement of the treadles 40 oblique. That is, the treadles 40 are swung up and down as shown in FIGS. 4 and 5 while they are pivoted left and right as shown in FIG. 6. Hence, the user not only treads on the treadles 40 but also twist on the treadles 40. Thus, the user uses the muscles in the legs together with the muscles in the hips and waist.

Furthermore, the treadmill 1 is not equipped with any handle. While using the treadmill 1, the user must use the muscles of almost the entire body (including the limbs) and concentrate to stay on the treadles 40.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A treadmill for enabling a user to tread and twist, the treadmill comprising:

a base;

a post having a threaded aperture extended from the base;

a pivotal unit comprising two inclined axles extended from the post;

two treadles each connected to a related one of the inclined axles;

two hydraulic cylinders each comprising an end connected to a related one of the treadles and another end connected to the base; and a linking unit comprising:

two cranks each connected to a related one of the inclined axles; an adjusting crew a U-shaped element connected to the adjusting screw which is threadedly engaged with the threaded aperture of the post;

a pulley supported on the U-shaped element; and a rope wound around the pulley and formed with two end each connected to a related one of the cranks.

2. The treadmill according to claim 1, wherein the base comprises a front crossbar, a rear crossbar and a keel provided between the front and rear crossbars.

3. The treadmill according claim 1, wherein the pivotal unit comprises two collars each provided on a related one of the inclined axles, two washers each provided on a related one of the inclined axles, two lower rings each provided on a related one of the inclined axles, two sleeves each provided on a related one of the inclined axles, two upper rings each provided on a related one of the inclined axles, two C-clips each provided on a related one of the inclined axles and two caps each provided on a related one of the inclined axles.

4. The treadmill according to claim 1 comprising a counter provided on the post and formed with a display and a control portion.

* * * * *